US008539651B1

(12) United States Patent
Williams

(10) Patent No.: US 8,539,651 B1
(45) Date of Patent: Sep. 24, 2013

(54) ZIPPER REPAIR SLIDER

(71) Applicant: James Marvin Williams, Oregon City, OR (US)

(72) Inventor: James Marvin Williams, Oregon City, OR (US)

( * ) Notice: Subject to any disclaimer, the term of this patent is extended or adjusted under 35 U.S.C. 154(b) by 0 days.

(21) Appl. No.: 13/753,297

(22) Filed: Jan. 29, 2013

(51) Int. Cl.
*A44B 19/26* (2006.01)

(52) U.S. Cl.
USPC ..... 24/430; 24/415; 24/416; 24/421; 24/426

(58) Field of Classification Search
USPC ..... 24/415, 416, 421, 426, 430
See application file for complete search history.

(56) References Cited

U.S. PATENT DOCUMENTS

| | | | | |
|---|---|---|---|---|
| 2,079,722 | A * | 5/1937 | Sundback | 156/257 |
| 2,405,509 | A * | 8/1946 | Marinsky | 24/430 |
| 2,681,491 | A * | 6/1954 | Snyder | 24/416 |
| 2,764,794 | A * | 10/1956 | Meech et al. | 24/416 |
| 2,779,988 | A * | 2/1957 | Simpson | 24/416 |
| 2,811,764 | A * | 11/1957 | Morin | 24/416 |
| 2,821,765 | A * | 2/1958 | Morin | 24/416 |
| 2,835,953 | A * | 5/1958 | Morin | 24/416 |
| 3,376,617 | A * | 4/1968 | Snyder | 24/416 |
| 4,023,244 | A * | 5/1977 | Doguchi et al. | 24/416 |
| 5,625,927 | A * | 5/1997 | Chu | 24/421 |
| 5,864,928 | A * | 2/1999 | Matsushima | 24/421 |
| 7,313,847 | B1 * | 1/2008 | Felix et al. | 24/426 |
| 8,082,635 | B2 * | 12/2011 | Leveau | 24/416 |
| 2003/0061691 | A1 * | 4/2003 | Lee | 24/430 |

* cited by examiner

*Primary Examiner* — Robert J Sandy
*Assistant Examiner* — David Upchurch
(74) *Attorney, Agent, or Firm* — Mersenne Law LLC

(57) ABSTRACT

A replacement zipper slider includes upper and lower plates, which are held together by a threaded fastener extending from one plate to the other; the plates are urged apart by a spring between them, and the threaded fastener sets a maximum limit on the distance between the plates.

13 Claims, 6 Drawing Sheets

ZIPPER REPAIR SLIDER

CONTINUITY AND CLAIM OF PRIORITY

This is an original U.S. patent application.

FIELD

The invention relates to separable-fasteners ("zippers") wherein the interlocking faces of each of the two dissociable, mating members have (a) approximately the same structural configuration and size, and (b) require the same manipulation to maneuver them together into mutual interlocking contact. More specifically, the invention relates to replacement zipper sliders in which a portion or component of the sliding device has a particular assembled relationship, and comprises a resilient or spring-biased element.

BACKGROUND

Zippers have a long and rich history, from their invention over 150 years ago, to the latest shapes, configurations and materials, where development continues today. The market for these fasteners has developed so that zippers are commonly sold in sets: left and right tapes with interlocking teeth, and one or more sliders accurately sized and constructed of compatible materials to assure an acceptably long life of the set. However, between the wide range of sizes, shapes, configurations and colors, and the typically lengthy service life of a zipper, it is often difficult or impossible to find suitable replacement parts for a broken zipper—more often, one must disassemble the garment or item and replace all the parts of the broken zipper when any part fails. This is inconvenient, and the repair cost often exceeds the value of the remaining service life of the item.

What is needed is a universal, or one-size-fits-many, replacement zipper slider. This could extend the useful life of many items with zippers, and when the item finally fails from some other cause, the replacement slider can be recovered and used to repair something else. Some replacement sliders are known (see, for example, U.S. Pat. No. 7,313,847, co-invented by the present applicant) but new designs that improve the function or manufacturability of these repair devices may be of value in this field.

SUMMARY

Replacement sliders to repair broken zippers are constructed in two complementary halves having suitably-sized Y-shaped channels to guide and merge the teeth of a zipper. The halves are joined by a pillar having a V-shaped profile at the head of the zipper (the bottom of the V pointing into the arms of the Y). The pillar is extensible so that the distance between the halves can be adjusted to accommodate zipper teeth of varying thickness. A spring forces the halves apart, so that they do not pinch or bind on the teeth, and a threaded adjustment fastener sets the maximum distance between the halves to prevent vertical misalignment between teeth.

BRIEF DESCRIPTION OF DRAWINGS

Embodiments of the invention are illustrated by way of example and not by way of limitation in the figures of the accompanying drawings in which like references indicate similar elements. It should be noted that references to "an" or "one" embodiment in this disclosure are not necessarily to the same embodiment, and such references mean "at least one."

DETAILED DESCRIPTION

Figure 5:
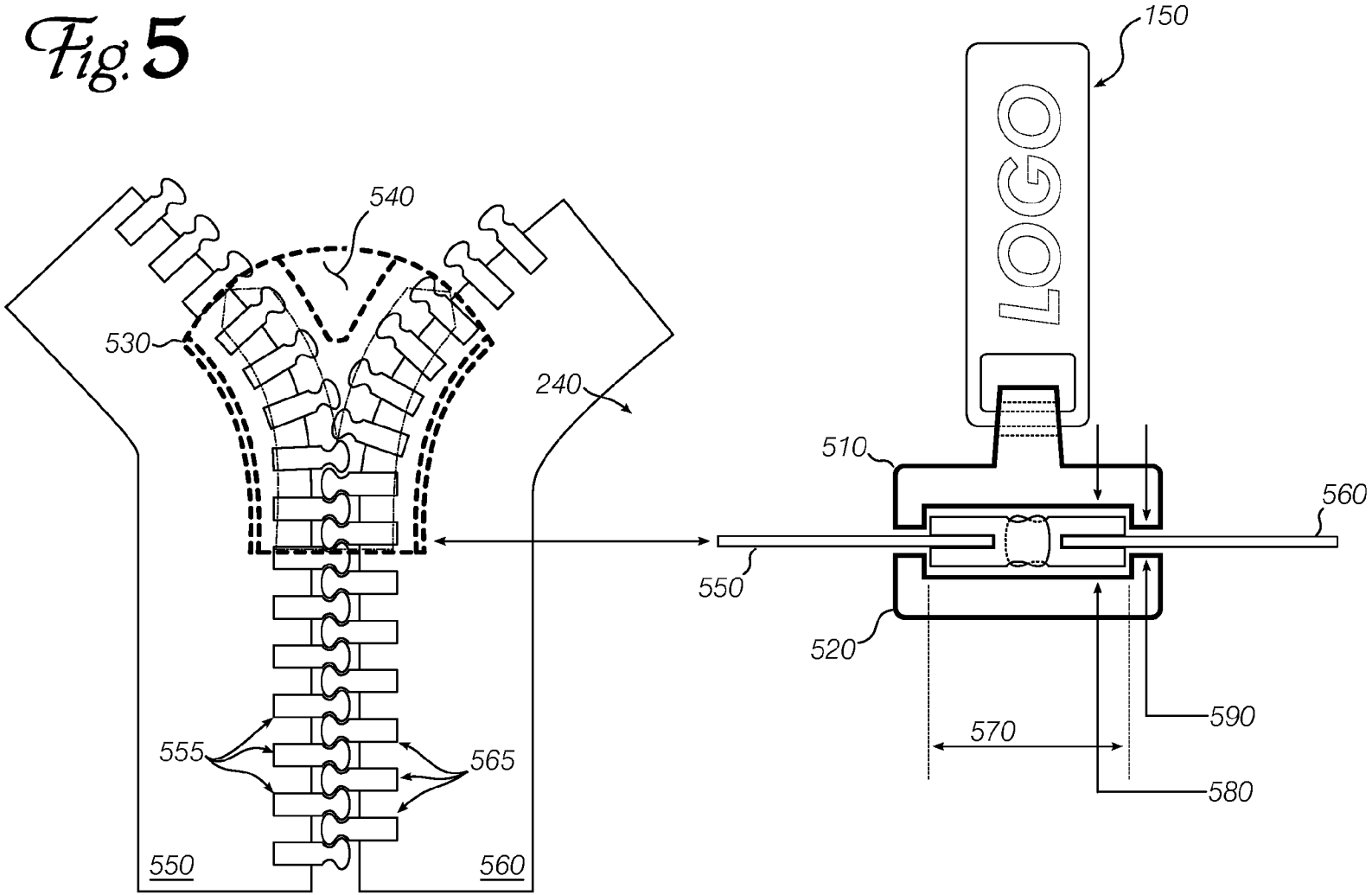
FIG. 5 shows the relationships between parts of a zipper and its slider.

Turning first to FIG. 5, some features of a typical zipper set are depicted. The illustration and this description can apply to prior-art zipper sliders as well as to embodiments of the invention, but it is useful to begin here for orientation purposes. FIG. 5 shows two halves of a partly-meshed zipper, including left tape 550 and right tape 560; each tape has a plurality of evenly-spaced teeth attached to it (555, 565). (The tapes are typically made of cloth or some other material that can be sewn, and the zipper is incorporated into the garment or other item by sewing the tapes to the edges of an opening.)

Towards the top of the zipper tapes, the teeth become unmeshed and the tapes bend away from each other. The meshed-to-unmeshed transition occurs within the body of a zipper slider, whose outline is shown in heavy dashed lines at 530. The interior of the slider forms a Y-shaped channel. Meshed zipper teeth exit the slider through the stem of the Y, and the unmeshed teeth of the left and right tapes exit the slider through the corresponding arms of the Y. A V-shaped pillar 540 is positioned at the top of the slider, between the arms of the Y. This pillar helps sequence the teeth so that they mesh correctly when the slider is raised (when the zipper is being closed); and forces the teeth apart to unmesh them when the slider is lowered (when the zipper is being opened).

At the right side of FIG. 5, an enlarged cross section shows the relationship of various parts of the zipper near the bottom of the Y-shaped channel. A top plate 510 of the slider has a protrusion on its upper surface to connect to a pull tab 150, and a rectangular (in cross section) indentation on its lower surface, which forms the ceiling or roof of the Y-shaped channel. A bottom plate 520 of the slider has a corresponding rectangular indentation on its upper surface, which forms the floor of the Y-shaped channel. The sides of the channel are open horizontally to allow the zipper tapes 550, 560 to escape the channel. The top and bottom plates are joined near the other end of the zipper, at the V-shaped pillar (540 in the plan view). The channel is roughly rectangular, having a width 570 and height 580 to fit the meshed zipper teeth exiting the channel at the bottom of the stem of the Y. The gap 590 at the side opening is large enough to accommodate the zipper tape, but not large enough to allow the zipper teeth to slide out of the channel sideways.

Figure 1:
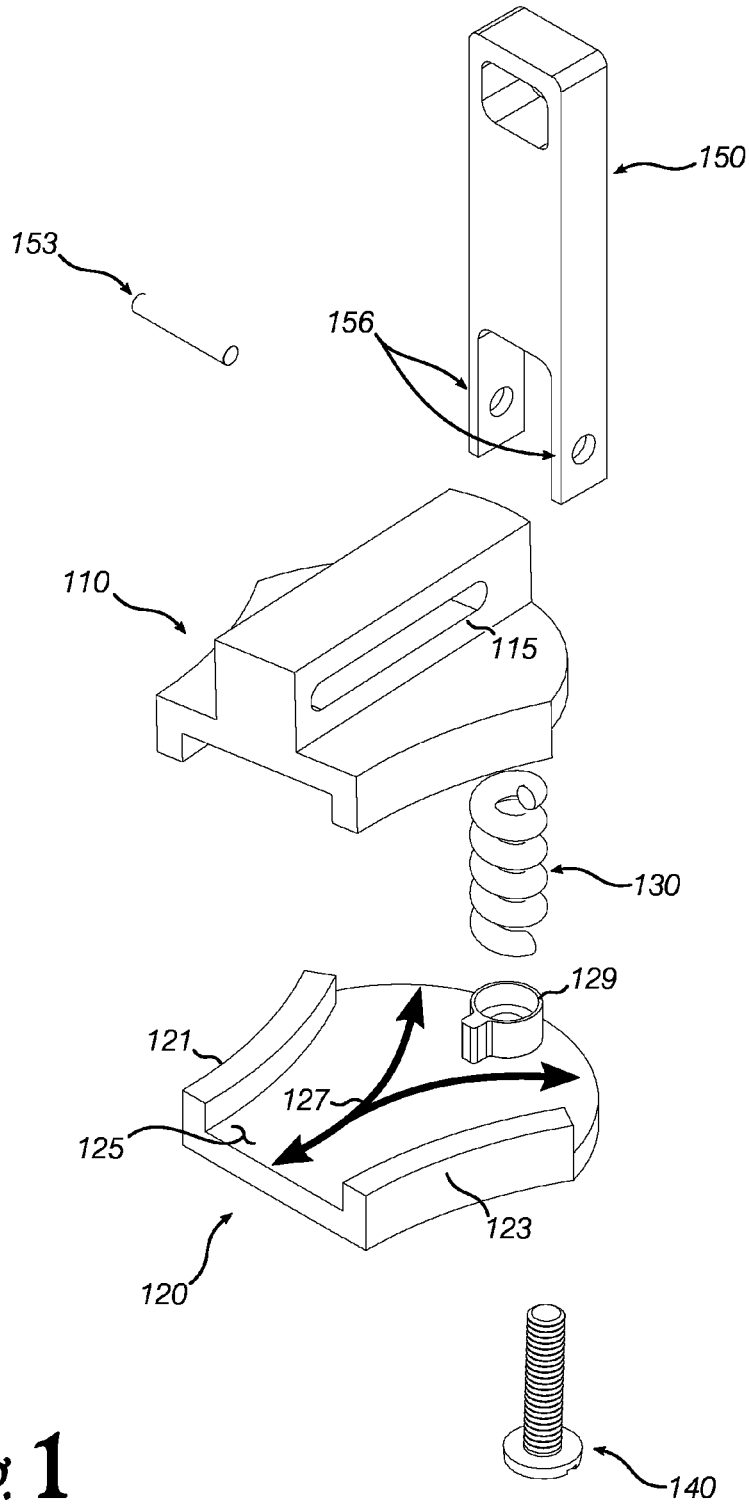
FIG. 1 shows an exploded view of an embodiment.

Turning now to FIG. 1, an exploded view of a three-dimensional computer-aided design ("CAD") model of an embodiment is shown. Some of the pieces have been displaced from a straight orthogonal decomposition so that the features are easier to see. The slider comprises a top plate 110, with a protrusion on its upper surface to connect to zipper pull 150. In this embodiment, the pull is attached to the slider top plate by a pin 153 that passes through holes 156 and through elongated channel 115 in the protrusion on top of the top plate. The Y-shaped channel in the lower surface of the top plate is not visible in this view.

Below the top plate 110 lies the bottom plate 120. In this exploded view, the sidewalls of the Y-shaped channel (121 and 123) and the floor of the channel 125 are visible. (Arrows 127 show the Y and indicate where the zipper teeth of the left and right tapes travel through the slider.) At the head or upper end of the slider is a keyed protrusion 129. A spring 130 is positioned between the top plate 110 and the bottom plate 120. Spring 130 becomes compressed as the top plate is brought closer to the bottom plate; the spring urges the plates apart. A threaded fastener 140 passes through one plate and into the other (in this embodiment, the fastener passes through the bottom plate 120 and is secured into a threaded hole in the top plate 110. The fastener holds the plates together, opposing the spring 130 and setting the maximum distance between the plates.

This also controls the height of the Y-shaped channel between the plates, i.e., distance 580 in FIG. 5. In an embodiment, the gap dimension corresponding to distance 590 is the channel height 580 less the heights of the sidewalls 121 and 123, and the corresponding sidewalls on the lower surface of the upper plate, shown at 211 and 213 in FIG. 2. The depths of the portions of the Y-shaped channels in the top and bottom plates may be approximately equal, so that the total channel height is approximately equally divided between the top and bottom of the slider, or one side may have a deeper channel than the other, so that the total channel height is unequally distributed between the top and bottom plates.

Figure 2:
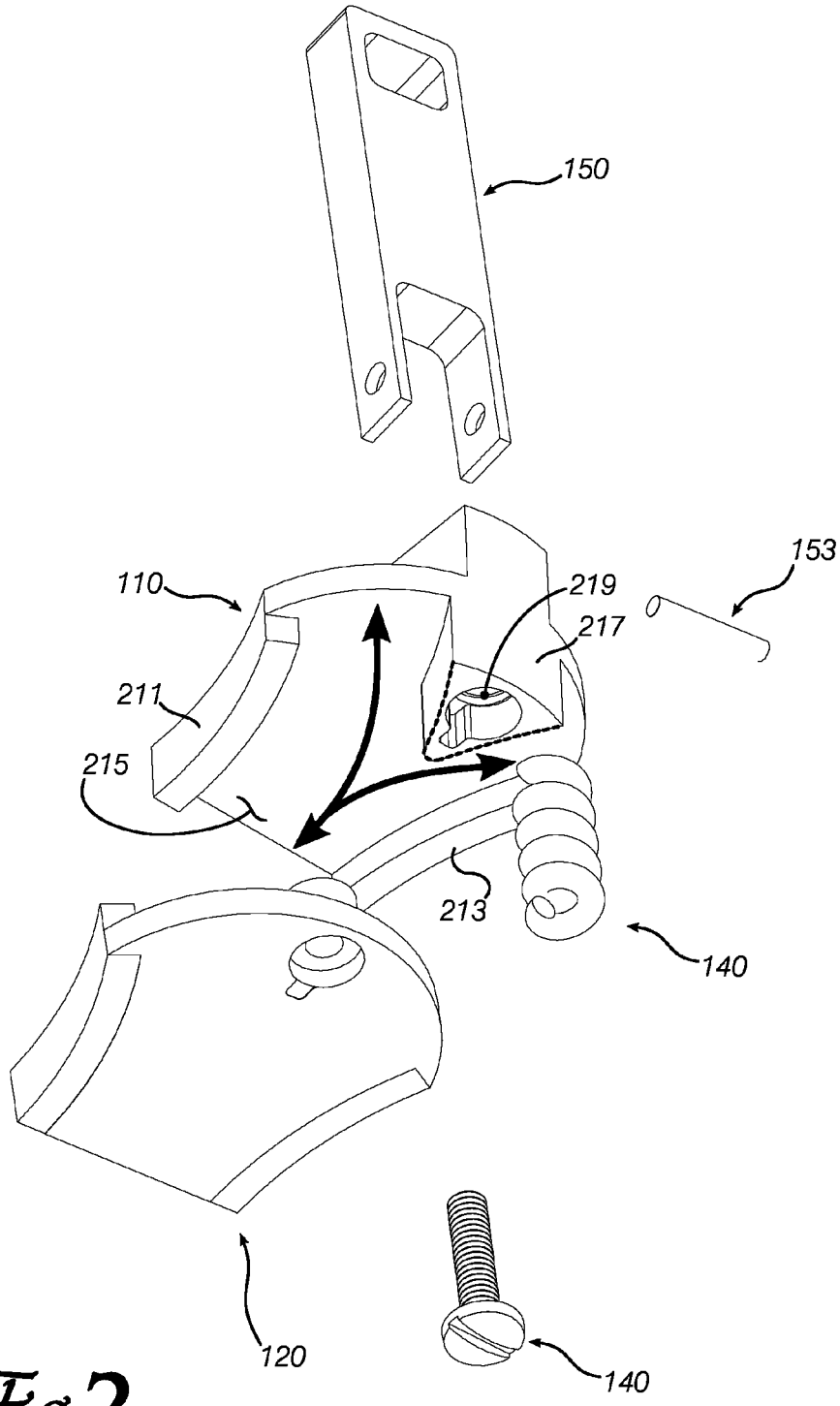
FIG. 2 shows a view of the exploded embodiment of FIG. 1, rendered from a different viewpoint.

FIG. 2 shows the same exploded parts as FIG. 1 (numbered identically) but from a different viewpoint. In this Figure, the Y-shaped channel in the lower surface of top plate 110 is visible; the channel is bounded by sidewalls 211 and 213, and ceiling or roof 215. The V-shaped pillar 217 is visible in this view; in this embodiment, the pillar extends downward from the top plate. The pillar has a keyed channel 219, shaped and sized to accept the keyed protrusion 129 of bottom plate 120. That is, keyed protrusion 129 fits slidably into keyed channel 219, allowing the distance between top and bottom plates to be adjusted. Spring 140 fits into a cup on keyed protrusion 129 and becomes compressed as the bottom plate is assembled with the top plate and the two are drawn together by threaded fastener 140. The keyed protrusion and corresponding keyed channel prevent the top plate from rotating with respect to the bottom plate about the V-shaped pillar. It is appreciated the pillar can be formed with other mating mechanisms, so long as the plates can be displaced vertically from each other, but cannot rotate with respect to each other (i.e., so that the upper and lower portions of the Y-shaped channel remain aligned).

Figure 4B:
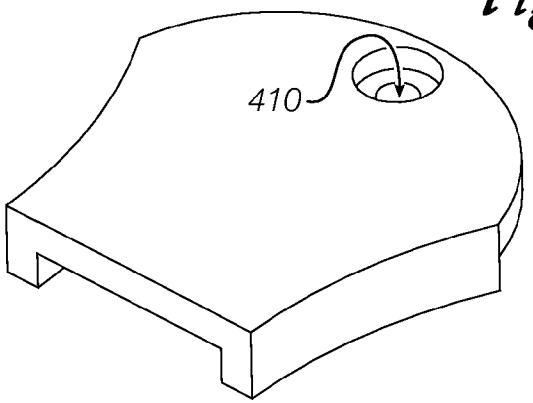
FIGS. 4A and 4B show top and bottom views, respectively, of a bottom plate according to an embodiment.
Figure 3B:
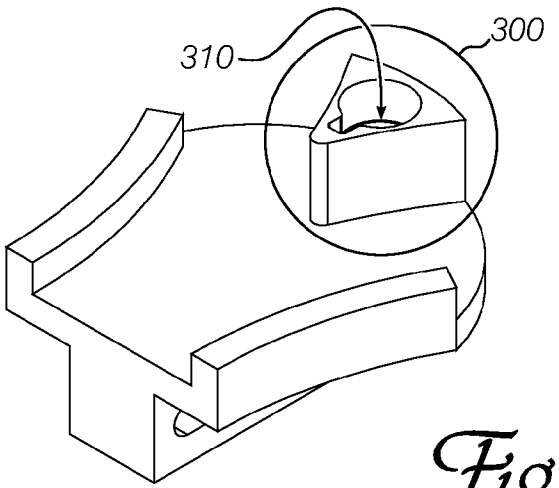
FIGS. 3A and 3B show top and bottom views, respectively, of a top plate according to an embodiment.
Figure 3A:
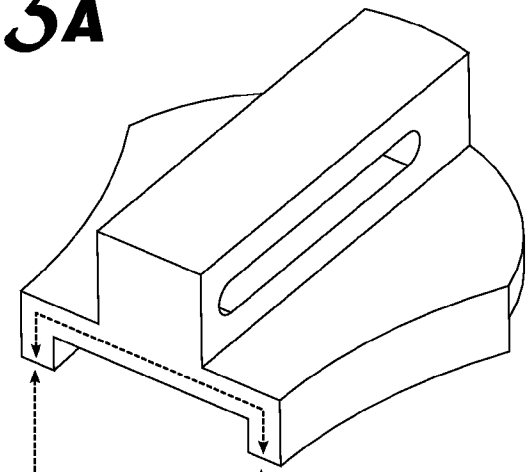
Figure 4A:
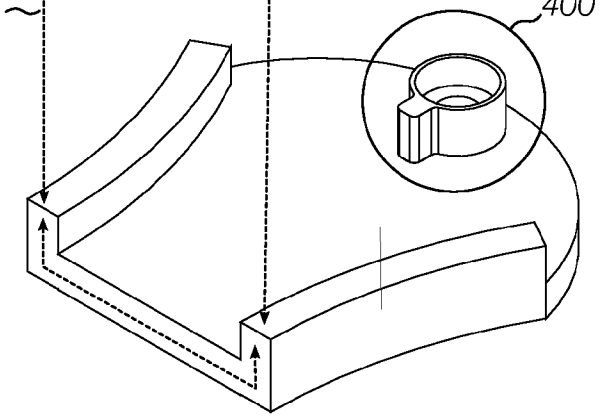

FIGS. 3A and 3B show the upper and lower surfaces, respectively, of a top plate according to an embodiment; while FIGS. 4A and 4B show the upper and lower surfaces of a corresponding bottom plate. Keyed protrusion 400 slides into keyed opening 310 of V-shaped pillar 300, and the top and bottom plates are secured by a threaded fastener inserted through unthreaded hole 410 and screwed into a threaded hole inside opening 310. This threaded hole may be supplied with a nylon thread-locking material to resist unintentional motion of the securing fastener. Thus, once the fastener has been adjusted so that channel height 580 suits a zipper on which the embodiment is installed, it is less likely to require further adjustment after extended use. Dashed lines 345 indicate the exit of the slider at the stem of the Y channel, corresponding to the enlarged cross section diagram shown at the right of FIG. 5.

Figure 7:
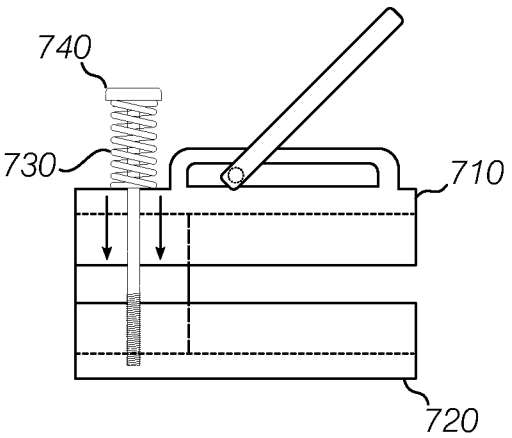
Fig. 7 (Prior Art)
FIG. 7 shows a side view of a prior-art replacement zipper slider, illustrating the differing forces acting on its constituent parts.
Figure 6:
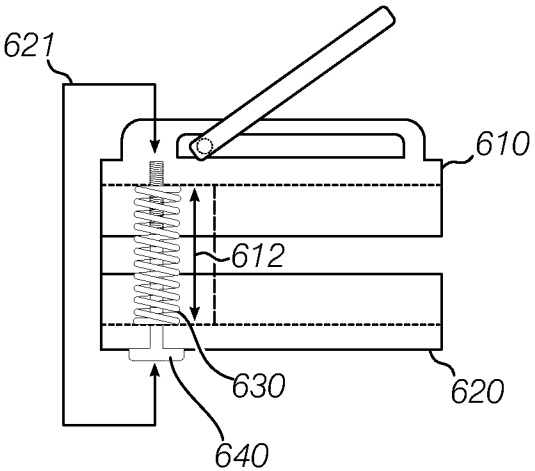
FIG. 6 is a side view of an embodiment, illustrating certain forces acting on its constituent parts.

FIG. 6 shows a side view of an embodiment of the invention, including its novel structure; while FIG. 7 shows a similar side view of a prior-art replacement zipper slider. In FIG. 6, top and bottom plates 610, 620 are aligned over each other, so that the Y channels formed in the upper surface of the bottom plate and in the lower surface of the top plate line up. At the left end of the side view, the V-shaped pillar that connects the top plate to the bottom plate may be seen. In an embodiment, a spring 630 lies between the top and bottom plates, and is compressed so that it urges the plates apart, as indicated by double-headed arrow 612. The spring's force is counteracted by a threaded fastener 640, which draws the plates together (621). The threaded fastener adjusts the maximum distance between the plates, and the spring ensures that the plates tend to stay at that distance. (An embodiment can be compressed by an outside force to push the plates closer together, but when the outside force is removed, the plates will return the maximum distance permitted by the threaded fastener.)

By way of comparison, FIG. 7 shows a side view of a prior-art replacement zipper slider. This device also has top and bottom plates 710, 720 with aligned Y channels and a V-shaped pillar at the left end, but the plates are pressed together by spring 730, whose tension can be set by threaded adjuster 740. The plates may have a minimum spacing set by a configuration of the pillar mating mechanism, or the minimum space may simply be that at which the floor and ceiling of the Y-shaped channel contact the teeth of the zipper. Spring 730 pushes the channel in top plate 710 firmly against the upper surface of the zipper teeth with a force that is proportional to the tension set by threaded adjuster 740. Critically, a force that acts to pry top plate 710 away from bottom plate 720 can do so merely by increasing the compression of spring 730. In particular, for example, extraneous fabric accidentally entering the channel can force the channel to widen, which can admit additional jamming fabric.

In contrast, in an embodiment of the invention as shown at FIG. 6, the maximum channel height is set by threaded adjuster 640. Thus, a slider according to an embodiment is not significantly more likely to jam than an original zipper slider. Furthermore, since the spring urges the plates apart rather than together, they tend not to press or ride on the zipper teeth, so the slider can operate more smoothly and with less force.

Figure 8:
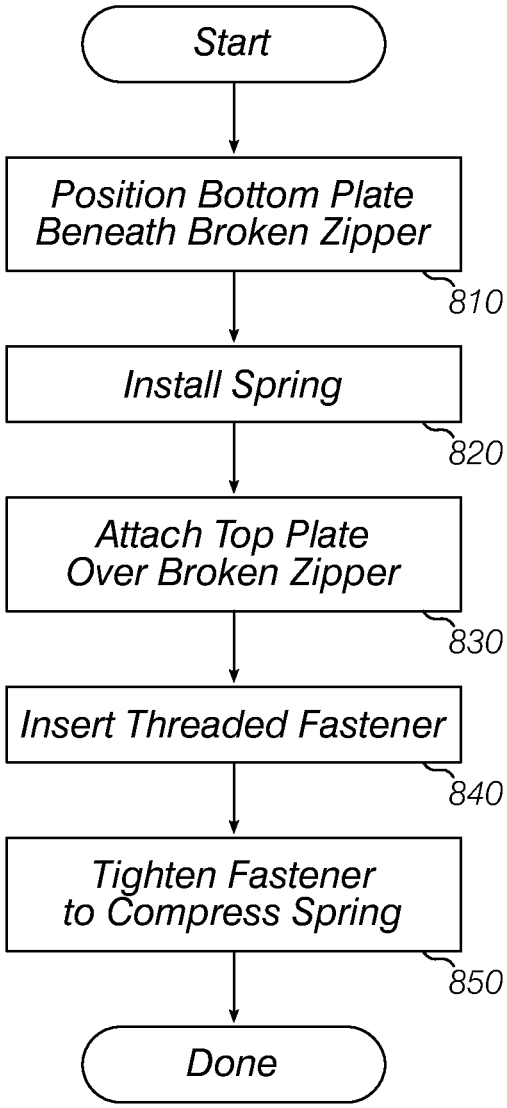
FIG. 8 is a flow chart explaining how to use an embodiment of the invention to repair a broken zipper.

FIG. 8 outlines the use of an embodiment of the invention to repair a broken zipper (e.g., one with a broken or missing slider). First, the bottom plate of the embodiment is positioned beneath the broken zipper (810), with several meshed teeth lying in the stem of the Y-shaped channel, and several unmeshed teeth lying in each arm of the Y-shaped channel. Next, the spring is installed (820). Now, the top plate is attached over the broken zipper (830), with its Y-shaped channel aligned with that of the bottom plate. The threaded fastener is inserted (840) (either top-to-bottom or bottom-to-top, depending on the configuration of the embodiment) and the fastener is tightened to compress the spring (850). By tightening the fastener, the channel height 580 can be reduced; by loosening it, the channel height can be increased. Proper adjustment is achieved when the channel height is slightly larger than the thickness of the zipper's teeth.

The present invention has been described largely by reference to specific physical forms and in terms of particular arrangements of the slidable connecting pillar between the top and bottom plates. However, those of skill in the art will recognize that zipper repair sliders can also be constructed somewhat differently than herein described. Such variations and alternate constructions are understood to be captured according to the following claims.

I claim:

1. A replacement slider to repair a broken zipper, comprising:

a bottom plate having a Y-shaped channel formed in an upper surface thereof;

a top plate having a similar Y-shaped channel formed in a lower surface thereof;

a spring to urge the top plate apart from the bottom plate;

a pillar having a V shape directed toward a joint between right and left arms of the Y-shaped channel channels, reversibly joining the bottom plate to the top plate, said pillar comprising:

a keyed protrusion extending upward from the upper surface of the bottom plate, the keyed protrusion having a cup in its upper extremity to accept a lower end of the spring;

a V-shaped pillar having a corresponding keyed indentation, said pillar extending downward from the lower surface of the top plate;

said keyed protrusion adapted to fit slidably inside said keyed indentation so that sliding motion of the protrusion within the indentation alters a compression of the spring and alters a distance between the top plate and the bottom plate; and a threaded fastener to adjust a maximum distance by which the spring can separate the top plate and the bottom plate.

2. The replacement zipper slider of claim 1 wherein the pillar comprises:

a bottom portion contiguous with the bottom plate; and a top portion contiguous with the top plate, and wherein said bottom and top portions of the pillar are shaped to mate in a complementary fashion.

3. The replacement zipper slider of claim 1 wherein the pillar comprises:

a bottom portion contiguous with the bottom plate; and a top portion contiguous with the top plate, and wherein said bottom and top portions of pillar nest slidably inside one another so that sliding motion of the bottom and top portions alters a distance between the top plate and the bottom plate.

4. The replacement zipper slider of claim 1 wherein the pillar is configured to resist rotation between the top plate and the bottom plate.

5. The replacement zipper slider of claim 1 wherein the top plate comprises an opening on an upper surface thereof, said opening to accept a slider pull tab.

6. The replacement zipper slider of claim 1 wherein the maximum distance can be adjusted over a range from less than a thickness of a zipper tooth to more than the thickness of the zipper tooth.

7. The replacement zipper slider of claim 1 wherein the threaded fastener screws into a threaded hole fitted with a nylon thread-locking material to resist inadvertent rotation of the threaded fastener.

8. The replacement zipper slider of claim 1 wherein a depth of the Y-shaped channel in the bottom plate is approximately equal to a depth of the Y-shaped channel in the top plate.

9. The replacement zipper slider of claim 1 wherein a depth of the Y-shaped channel in the bottom plate is greater than a depth of the Y-shaped channel in the top plate.

10. The replacement zipper slider of claim 1 wherein a depth of the Y-shaped channel in the bottom plate is less than a depth of the Y-shaped channel in the top plate.

11. The replacement zipper slider of claim 1 wherein the spring is a coil spring.

12. The replacement zipper slider of claim 11 wherein a centerline of the threaded fastener is substantially coincident with a centerline of the coil spring.

13. The replacement zipper slider of claim 12 wherein a centerline of the threaded fastener is substantially coincident with a centerline of the pillar.

* * * * *